US007593672B2

(12) United States Patent
Woo

(10) Patent No.: US 7,593,672 B2
(45) Date of Patent: Sep. 22, 2009

(54) DEVELOPER SUPPLYING APPARATUS AND DEVELOPING APPARATUS HAVING THE SAME

(75) Inventor: Ji-hoon Woo, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/019,729

(22) Filed: Jan. 25, 2008

(65) Prior Publication Data

US 2008/0304868 A1 Dec. 11, 2008

(30) Foreign Application Priority Data

Jun. 11, 2007 (KR) ..... 10-2007-0056622

(51) Int. Cl.
*G03G 15/08* (2006.01)

(52) U.S. Cl. ..... 399/258

(58) Field of Classification Search ..... 399/119, 399/258, 260, 262, 359, 254, 255, 263; 222/DIG. 1
See application file for complete search history.

(56) References Cited

U.S. PATENT DOCUMENTS

| | | | | |
|---|---|---|---|---|
| 4,743,936 | A * | 5/1988 | Bares | 399/254 |
| 5,537,191 | A * | 7/1996 | Aruga et al. | 399/254 |
| 5,629,758 | A | 5/1997 | Kageyama et al. | |
| 5,708,939 | A * | 1/1998 | Oikawa et al. | 399/252 |
| 5,943,538 | A | 8/1999 | Choi | |
| 6,567,635 | B2 * | 5/2003 | Livadas et al. | 399/253 |
| 2003/0117892 | A1 | 6/2003 | Litwiller | |
| 2008/0118290 | A1 * | 5/2008 | Sato | 399/358 |

FOREIGN PATENT DOCUMENTS

| | | | |
|---|---|---|---|
| CN | 2421415 Y | | 2/2001 |
| DE | 4116616 | | 11/1992 |
| JP | 58-113036 | | 7/1983 |
| JP | 60010274 A | * | 1/1985 |
| JP | 5-61343 | | 3/1993 |
| JP | 06167880 A | * | 6/1994 |
| JP | 11119530 A | * | 4/1999 |
| JP | 2000-214741 | | 8/2000 |
| JP | 2001147629 A | * | 5/2001 |
| JP | 2001290350 A | * | 10/2001 |

(Continued)

OTHER PUBLICATIONS

EP Search Report issued in Application No. 08157609.2 mailed Oct. 24, 2008.

(Continued)

*Primary Examiner*—Robert Beatty
(74) *Attorney, Agent, or Firm*—DLA Piper LLP US

(57) ABSTRACT

A developer supplying apparatus includes a developer lump prevention unit that reduces the aggregation of developer into lumps in the path, which defines the supply passage of developer from the developer cartridge, in which the developer is stored, to the developing cartridge, which houses the developing roller. The developer lump prevention unit includes a developer lump removal member disposed in the path and a driving mechanism to drive the developer lump removal member to move in the path to prevent the developer lumps from forming and/or to break up lumps that had already formed in the path.

21 Claims, 4 Drawing Sheets

FOREIGN PATENT DOCUMENTS

| | | | |
|---|---|---|---|
| JP | 2005215438 A | * | 8/2005 |
| KR | 100174688 | | 11/1998 |
| RU | 2 137 169 C1 | | 9/1999 |

OTHER PUBLICATIONS

English language abstract of JP 2000-214741, published Aug. 4, 2000.
Machine English language translation of JP 2000-214741, published Aug. 4, 2000.
English language abstract of JP 58-113036, published Jul. 5, 1983.
English language abstract of DE 41 16 616, published Nov. 26, 1992.
English language abstract of JP 5-61343, published Mar. 12, 1993.
English language abstract of KR 100174688, published Nov. 5, 1998.
Office Action Issue in Chinese Application No. 200810090562.4, mailed Jun. 5, 2009.
Partial English language translation of Office Action Issue in Chinese Application No. 200810090562.4, mailed Jun. 5, 2009.
English language abstract of CN 2421415Y, published Feb. 28, 2001.
Office Action issued in Russian Application No. 2008123719, mailed May 20, 2009.
English langauge abstract of RU 2,137,169 C1, published Sep. 10, 1999.

* cited by examiner

DEVELOPER SUPPLYING APPARATUS AND DEVELOPING APPARATUS HAVING THE SAME

CROSS-REFERENCE TO RELATED APPLICATIONS

This application claims all benefits accruing under 35 U.S.C. §119 from Korean Patent Application No. 2007-0056622, filed on Jun. 11, 2007, in the Korean Intellectual Property Office, the entire disclosure of which is incorporated herein by reference.

BACKGROUND OF THE INVENTION

1. Field of the Invention

The present invention relates to a developer supply of an image forming apparatus, and more particularly, to a developer supplying apparatus with a separate developer cartridge, and to a developing apparatus having the same.

2. Description of the Related Art

FIG. 1 illustrates a conventional image forming apparatus. As illustrated, the conventional image forming apparatus comprises a feeding unit 10 to load printing media, an image forming unit 20 to form an image on the printing media supplied from the feeding unit 10, a fixing unit 30 to fix the image on the surface of the printing medium by applying heat and pressure to the developer image formed on the printing medium, and a delivery unit 40 to discharge printing medium to exterior.

The image forming unit 20 may include a photoconductor, a charging unit to charge the photoconductor to an electric potential, a light exposure unit to form an electrostatic latent image on the photoconductor, a developing apparatus to develop the electrostatic latent image on the photoconductor by applying the developer thereto, and a transfer unit to transfer the image developed on the photoconductor onto the printing medium.

The developing apparatus includes a developing roller to apply the developer on the photoconductor, and a developer supplying roller to supply the developer to the developing roller. A developing apparatus may be classified into one of an integrated type in which the developer is held within the casing as the developing apparatus, and a separate developer cartridge type, in which the developer is held in a separated casing (hereinafter referred to as a developer cartridge), which may be detachable from the developing cartridge, which houses the other portions, e.g., the developing roller, the developer supplying roller, or the like, of the developing apparatus.

In the case of a removable developer cartridge type, the developer may be supplied from the developer cartridge to the developing cartridge by mainly either the use of an auger that transports the developer or by allowing the developer to free fall.

When an auger is used, the auger is typically disposed in the path connecting the developer cartridge with the developing cartridge, and the developer is supplied by the rotation of the auger. According to this method, a horizontal or a level path connecting the developer cartridge with the developing cartridge is provided. If the path is sufficiently slanted, the developer can still free fall or slide along the slope independent of the rotation of the auger so that a precise control of the amount of the developer being supplied may be difficult. In some cases, the straight path may not be possible because other components may be in the way, and thus a meandering path may be necessary, which requires a flexible auger to be used, which in turn increases the material cost.

In the method of using the free fall of the developer, the path connecting the developer cartridge with the developing cartridge is vertical or is slanted with a sufficient slope to allow the developer to free fall into the developing cartridge. According to this method, however, lumps of the developer may form along the path. Because the viscosity and/or the fluidity of the developer may vary according to the surrounding environmental conditions and/or the state of the particular developer, over time the developer particles may aggregate together to form lumps, and may accumulate, e.g., along the walls of the path. As a result, the motor for supplying the developer may not operate properly, and an overload of the same may occur, and/or the developer may not be supplied properly so that the quality of the printed image may suffer.

SUMMARY OF THE INVENTION

Aspects of the present invention relate to a developer supplying apparatus to prevent aggregation of developer particles along the developer passage between a developer cartridge and a developing cartridge, particularly, in a separate developer cartridge type structure, and to a developing apparatus having the same.

Additional aspects and/or advantages of the invention will be set forth in part in the description which follows and, in part, will be obvious from the description, or may be learned by practice of the invention.

According to an aspect of the present invention, there is provided a developer supplying apparatus comprising a path disposed between a developer cartridge and a developing cartridge, the path defining a free fall passage of developer from the developer cartridge onto said developing cartridge; and a developer lump prevention unit configured to reduce a presence of developer lumps in said path.

According to another aspect, there is provided a developing apparatus, which comprises a developer cartridge configured to hold developer therein, a developing cartridge for developing an electrostatic latent image formed on a photoconductor, a path disposed between the developer cartridge and the developing cartridge, the path defining a free fall passage of the developer from the developer cartridge to the developing cartridge, and a developer lump prevention unit configured to reduce a presence of developer lumps in the path.

According to yet another aspect, an image forming apparatus comprises a photoconductor configured to carry thereon an electrostatic latent image, a developing apparatus to develop the electrostatic latent image into a developed image using developer, a transfer unit configured to transfer the developed image onto a printing medium to form a transferred image thereon, and a fixing unit to fix said transferred image on said printing medium, wherein the developing apparatus comprises a developer cartridge configured to hold the developer therein, a developing cartridge configured to apply said developer over the electrostatic latent image formed on the photoconductor, a path disposed between the developer cartridge and the developing cartridge, the path defining a free fall passage of the developer from the developer cartridge to the developing cartridge, and a developer lump prevention unit configured to reduce a presence of developer lumps in the path.

According to one aspect, the developer lump prevention unit may comprise a developer lump removal member disposed in the path and a driving mechanism configured to drive the developer lump removal member into a movement within the path.

According to another aspect, the developer lump removal member may comprise an elastic member, wherein the movement comprises a reciprocating movement of the elastic member such that the elastic member alternates between a first state of being compressed and a second state of being decompressed.

According to further another aspect, the driving mechanism may comprise a driving source configured to provide a motional force and a motional force delivery mechanism to transfer the motional force from the driving source to the developer lump removal member.

According to yet further another aspect, the motional force delivery mechanism may be configured to convert the motional force of the driving source from a rotational motional force to a linear motional force to impart a reciprocating linear motion to the developer lump removal member.

According to yet another aspect, the motional force delivery mechanism may comprise an eccentric rotating protrusion coupled to the driving source and a loop member to move in association with the eccentric rotating protrusion, the loop member being coupled to the developer lump removal member.

According to even yet another aspect, the loop member may comprise an opening to receive the eccentric rotating protrusion in such a manner that the eccentric rotating protrusion rotates within the opening to cause the loop member to be in the reciprocating linear motion.

According to another aspect, the length across far ends of the opening may be made to be equal to or longer than the diameter of a rotational path of the eccentric rotating protrusion.

According to another aspect, the driving source may comprise a motor that is disposed in either the developer cartridge or the developing cartridge.

In addition, further aspects will become apparent by reference to the drawings and by study of the following descriptions.

BRIEF DESCRIPTION OF THE DRAWINGS

These and/or other aspects and advantages of the invention will become apparent and more readily appreciated from the following description of the embodiments, taken in conjunction with the accompanying drawings, of which.

Throughout the drawings, like reference numerals will be understood to refer to like parts, components and/or structures.

DETAILED DESCRIPTION OF SEVERAL EMBODIMENTS

The present invention will be described more fully hereinafter with reference to the accompanying drawings, in which several embodiments of the invention are shown.

Figure 1:
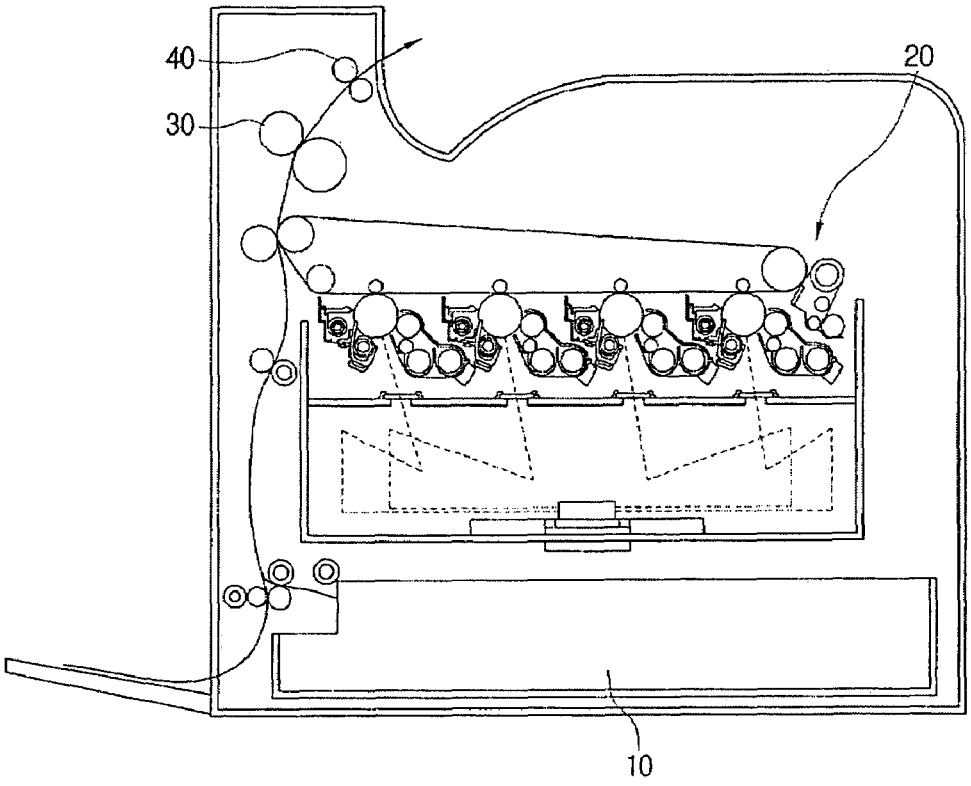
FIG. 1 (PRIOR ART)
FIG. 1 is a schematic view illustrating an example of a conventional image forming apparatus.
Figure 2:
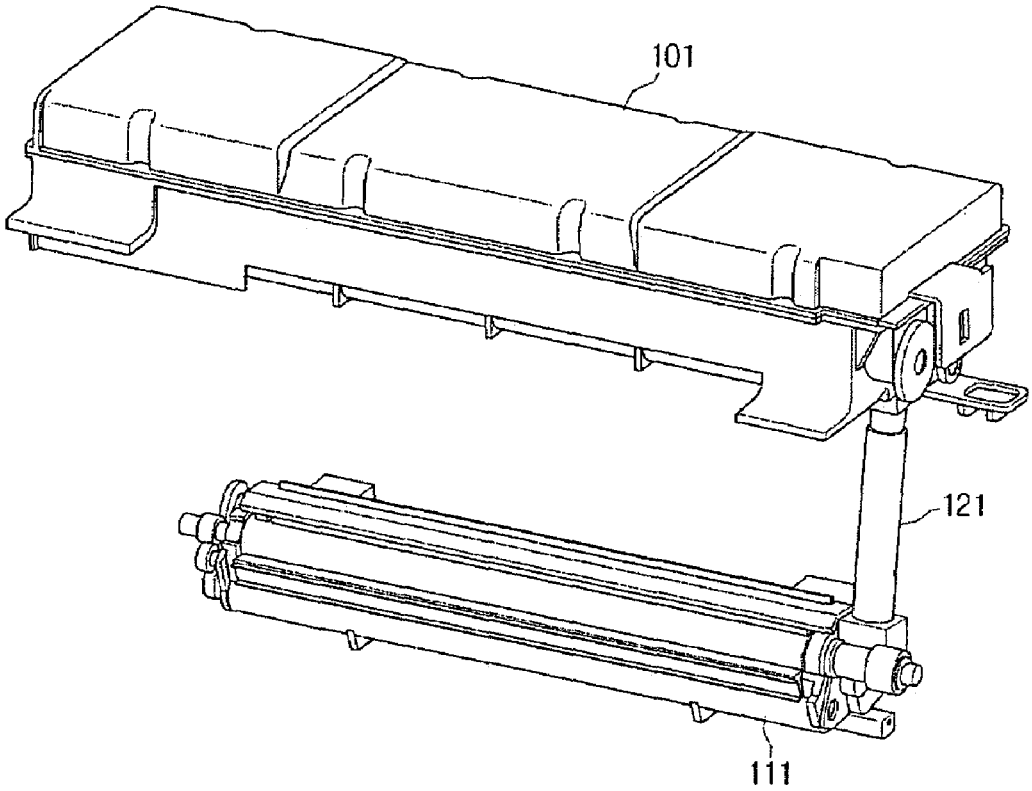
FIG. 2 is a schematic view illustrating a developing apparatus according to an exemplary embodiment of the present invention.
Figure 3:
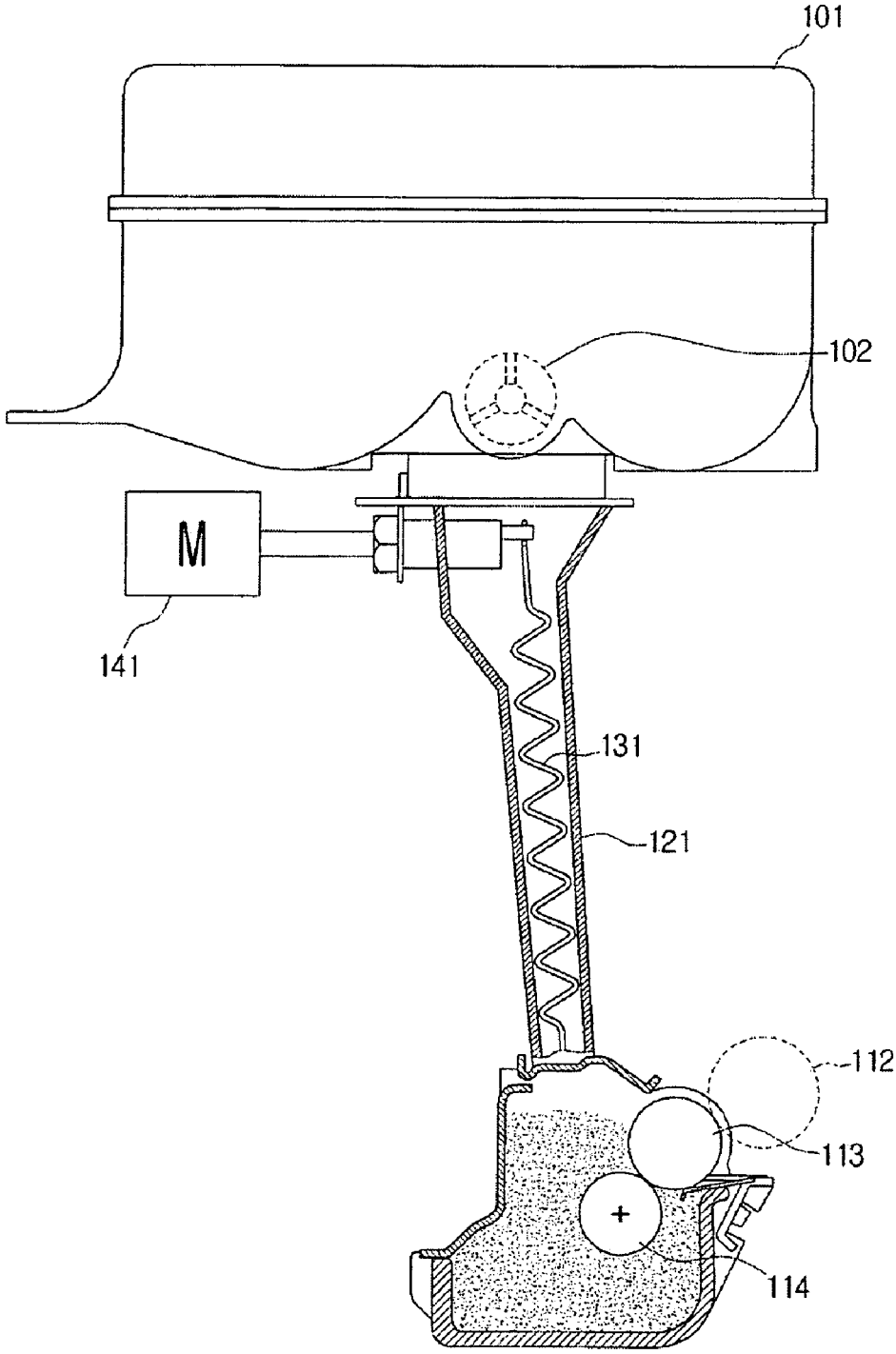
FIG. 3 is a sectional view of the developing apparatus of FIG. 2.

FIGS. 2 and 3 illustrate a developing apparatus and a sectional view thereof according to an exemplary embodiment of the present invention.

A developer cartridge 101 holds the developer. An agitating member 102 is provided in the developer cartridge 101. The agitating member 102 agitates the developer in the developer cartridge 101, and transfers the agitated developer to a path 121, which connects the developer cartridge 101 to a developing cartridge 111.

The developing cartridge 111 may comprise a developing roller 113 and a supplying roller 114, and may or may not include within its housing a photoconductive medium 112. An electrostatic latent image may be formed on the surface of the photoconductive medium 112 by being exposed to a light from a light exposure unit (not shown). The developing roller 113 applies the developer on the electrostatic latent image on the surface of the photoconductive medium 112. The supplying roller 114 supplies the developer to the developing roller 113.

The path 121 forms the passage between the developer cartridge 101 and the developing cartridge 111, allowing the developer in the developer cartridge 101 free fall onto, and to thus be supplied to, the developing cartridge 111.

A developer lump removal member 131 is disposed in the interior of the path 121. In an embodiment, the developer lump removal member 131 may be driven by a driving source 141 to move in a repeated and continuous motion to prevent the developer particles from aggregating together and/or to remove or break apart lumps of developer that had already formed on the path 121. The motion of the developer lump removal member 131 could alternatively be made periodic and/or random.

The developer lump removal member 131 may be an elastic member such as a spring. The elastic member may be made to be compressed and extended repeatedly to prevent or clear the lumped developer inside the path 121.

By using the developer lump removal member 131, aggregation of the developer into lumps in the path 121 can be prevented as the movement of the developer lump removal member 131 promotes the developer particles to remain segregated. The developer lump removal member 131 may also break up lumps that had already been formed in the path 121. This in turn reduces the likelihood of blockage of the path 121, and thus reduces the possibility of the overloading of the developer supply motor and/or the quality degradation of printed images due to improper supply of the developer to the developer cartridge 111.

The driving source 141 provides driving force to move the developer lump removal member 131. The driving source 141 may be a solenoid moving in a reciprocating linear motion, or a motor that provides a rotational motion. A motor 141 may be a motor disposed in the developer cartridge 101 or in the developing cartridge 111, or may be a dedicated motor to drive the developer lump removal member 131, exclusively. The driving source 141 may be directly connected with the developer lump removal member 131, or connected with the developer lump removal member 131 through a motional force delivery mechanism.

A motional force delivery mechanism transfers the motion from the driving source to the developer lump removal member 131, and may also change the direction of the motion. The motion power delivery mechanism may, for example, convert the rotational motion into a reciprocating linear motion, which is then transferred to the developer lump removal member 131. A cam may be a representative example of such a motional force delivery mechanism.

Figure 4:
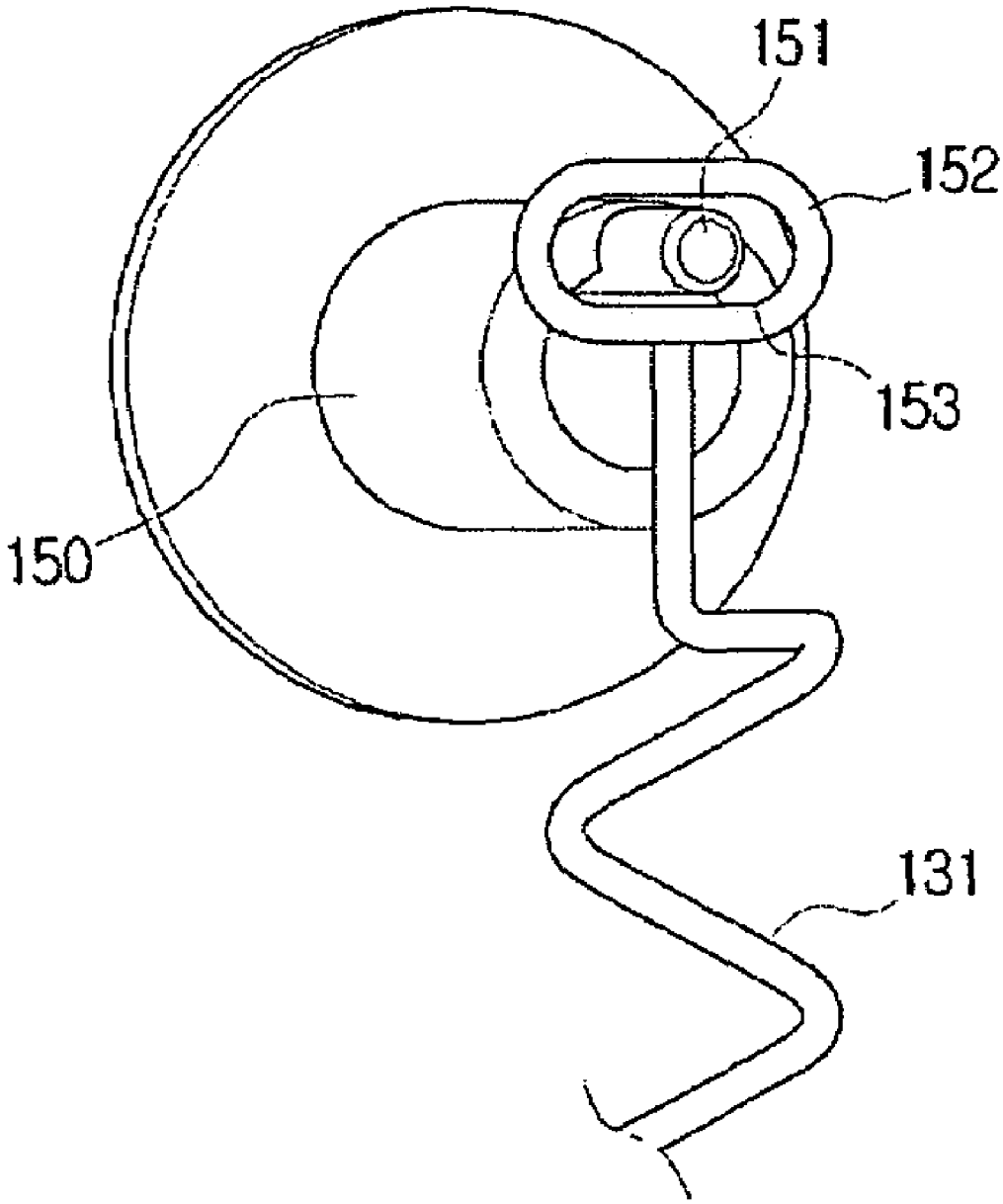
FIG. 4 is a view illustrating the structure and operation of a power delivery mechanism according to an exemplary embodiment of the present invention.

FIG. 4 is a view illustrating the structure and operation of a motional force delivery mechanism according to an embodiment of the present invention.

A rotating unit 150 is connected to a source of rotational motion, for example, a motor, and rotates about a rotational axis. An eccentric rotating protrusion 151 is extended eccentrically from, in other words, off the rotational axis of, the rotating unit 150. The eccentric rotating protrusion 151 moves in a circular motion while the rotating unit 150 rotates. The eccentric rotating protrusion 151 is inserted into an opening 153 of a loop member 152, and slides within the opening 153 of the loop member 152 while the eccentric rotating protrusion 151 moves in the circular motion. According to movement of the eccentric rotating protrusion 151 in the opening 153, the loop member 152 performs a reciprocating linear motion. In an embodiment, the length of the opening 153 may preferably be equal to or longer than the diameter of the circular path along which the eccentric rotating protrusion 151 travels.

The loop member 152 is coupled to one end of the developer lump removal member 131. As such, the developer lump removal member 131 moves in a reciprocating linear motion according to the reciprocating linear motion of the loop member 152. If the developer lump removal member 131 is an elastic member, the developer lump removal member 131 may repeat compression and extension. As described above, the developer lump removal member 131 moves on the path connecting the developer cartridge 101 with a developing cartridge 111 such that the developer lump removal member 131 may prevent the formation of lumps of developer in the path 121 or may break up or clear the lumps of developer that may have formed in the path 121.

As described above, according to the exemplary embodiments of the present invention, accumulation or aggregation of the developer along the developer passage between a developer cartridge and a developing cartridge is prevented. An overload of a developer supply motor or a lowered image quality due to clogged developer supplying path, is accordingly reduced.

While the present invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A developer supplying apparatus, comprising:

a path disposed between a developer cartridge and a developing cartridge, said path defining a free fall passage of developer from said developer cartridge to said developing cartridge; and a developer lump prevention unit configured to reduce lumping of said developer in said path, said developer lump prevention unit comprising:

a developer lump removal member disposed to be movable in said path, a movement of said developer lump removal member within said path causing removal of lumps of said developer formed in said path; and a driving mechanism configured to drive said developer lump removal member into said movement, said driving mechanism comprising:

a driving source configured to generate a motional force; and a motional force delivery mechanism to transfer said motional force from said driving source to said developer lump removal member, wherein said motional force delivery mechanism is configured to convert a rotational movement received from said driving source into a reciprocating linear movement.

2. The developer supplying apparatus of claim 1, wherein said developer lump removal member comprises an elastic member.

3. The developer supplying apparatus of claim 1, wherein said motional force delivery mechanism comprises:

an eccentric rotating protrusion coupled to said driving source so as to thereby rotate; and a loop member configured to move in association with said eccentric rotating protrusion, said loop member being coupled to one end portion of said developer lump removal member.

4. The developer supplying apparatus of claim 3, wherein said loop member comprises an elongated opening to receive interferingly therein said eccentric rotating protrusion.

5. The developer supplying apparatus of claim 4, wherein said elongate opening has a length that is larger than or equal to a diameter of rotational range of said eccentric rotating protrusion.

6. The developer supplying apparatus of claim 1, wherein said driving source comprises a motor, said motor being disposed in one of said developer cartridge and said developing cartridge.

7. A developing apparatus, comprising:

a developer cartridge configured to hold developer therein;

a developing cartridge configured to apply said developer supplied from said developer cartridge to, and to thereby develop, an electrostatic latent image formed on a photoconductor;

a path between said developer cartridge and said developing cartridge, said path defining a free fall passage of said developer from said developer cartridge to said developing cartridge; and a developer lump prevention unit configured to reduce lumping of said developer in said path, said developer lump prevention unit comprising:

a developer lump removal member disposed to be movable in said path, a movement of said developer lump removal member within said path causing removal of lumps of said developer formed in said path; and a driving mechanism configured to drive said developer lump removal member into said movement, said driving mechanism comprising:

a driving source configured to generate a motional force; and a motional force delivery mechanism to transfer said motional force from said driving source to said developer lump removal member, wherein said motional force delivery mechanism is configured to convert a rotational movement received from said driving source into a reciprocating linear movement.

8. The developing apparatus of claim 7, wherein said developer lump removal member comprises an elastic member.

9. The developing apparatus of claim 7, wherein said motional force delivery mechanism comprises:

an eccentric rotating protrusion coupled to said driving source so as to thereby rotate; and a loop member configured to move in association with said eccentric rotating protrusion, said loop member being coupled to one end portion of said developer lump removal member.

10. The developing apparatus of claim 9, wherein said loop member comprises an elongated opening to receive interferingly therein said eccentric rotating protrusion.

11. The developing apparatus of claim 10, wherein said elongate opening has a length that is larger than or equal to a diameter of rotational range of said eccentric rotating protrusion.

12. The developing apparatus of claim 7, wherein said driving source comprises a motor, said motor being disposed in one of said developer cartridge and said developing cartridge.

13. A developer cartridge for supplying developer to a developer supplying apparatus, comprising:

an agitating member configured to agitate said developer stored in said developer cartridge, wherein said developer supplying apparatus comprises:

a path between said developer cartridge and an developing cartridge, said path defining a passage through which said developer from said developer cartridge is supplied to said developing cartridge; and a developer lump prevention unit configured to reduce lumping of said developer in said path, said developer lump prevention unit comprising:

a developer lump removal member disposed to be movable in said path, a movement of said developer lump removal member within said path causing removal of lumps of said developer formed in said path; and a driving mechanism configured to drive said developer lump removal member into said movement, said driving mechanism comprising:

a driving source configured to generate a motional force; and a motional force delivery mechanism to transfer said motional force from said driving source to said developer lump removal member, wherein said motional force delivery mechanism is configured to convert a rotational movement received from said driving source into a reciprocating linear movement.

14. The developer cartridge of claim 13, wherein said developer lump removal member comprises an elastic member.

15. The developer cartridge of claim 13, wherein said motional force delivery mechanism comprises:

an eccentric rotating protrusion coupled to said driving source so as to thereby rotate; and a loop member configured to move in association with said eccentric rotating protrusion, said loop member being coupled to one end portion of said developer lump removal member.

16. The developer cartridge of claim 15, wherein said loop member comprises an elongated opening to receive interferingly therein said eccentric rotating protrusion.

17. The developer cartridge of claim 15, wherein said elongate opening has a length that is larger than or equal to a diameter of rotational range of said eccentric rotating protrusion.

18. The developer cartridge of claim 13, wherein said driving source comprises a motor, said motor being disposed in one of said developer cartridge and said developing cartridge.

19. A developing cartridge for applying developer, and to thereby develop an electrostatic latent image, said developer being received through a developer supplying apparatus that supplies said developer stored in a developer cartridge to said developing cartridge, wherein said developer supplying apparatus comprises:

a passage between said developer cartridge and an developing cartridge; and a developer lump prevention unit configured to reduce lumping of said developer in said passage, said developer lump prevention unit comprising:

a developer lump removal member disposed to be movable in said passage, a movement of said developer lump removal member within said passage causing removal of lumps of said developer formed in said passage; and a driving mechanism configured to drive said developer lump removal member into said movement, said driving mechanism comprising:

a driving source configured to generate a motional force; and a motional force delivery mechanism to transfer said motional force from said driving source to said developer lump removal member, wherein said motional force delivery mechanism is configured to convert a rotational movement received from said driving source into a reciprocating linear movement.

20. A developer supplying apparatus, comprising:

a path disposed between a developer cartridge and a developing cartridge, said path defining a free fall passage of developer from said developer cartridge to said developing cartridge; and a developer lump prevention unit configured to reduce lumping of said developer in said path, said developer lump prevention unit comprising:

a developer lump removal member disposed to be movable in said path, a reciprocating linear movement of said developer lump removal member within said path causing removal of lumps of said developer formed in said path; and a driving mechanism configured to drive said developer lump removal member into said reciprocating linear movement.

21. A developing apparatus, comprising:

a developer cartridge configured to hold developer therein;

a developing cartridge configured to apply said developer supplied from said developer cartridge to, and to thereby develop, an electrostatic latent image formed on a photoconductor;

a path between said developer cartridge and said developing cartridge, said path defining a free fall passage of said developer from said developer cartridge to said developing cartridge; and a developer lump prevention unit configured to reduce lumping of said developer in said path, said developer lump prevention unit comprising:

a developer lump removal member disposed to be movable in said path, a reciprocating linear movement of said developer lump removal member within said path causing removal of lumps of said developer formed in said path; and a driving mechanism configured to drive said developer lump removal member into said reciprocating linear movement.

* * * * *